US011105130B2

(12) United States Patent
Seelbinder et al.

(10) Patent No.: US 11,105,130 B2
(45) Date of Patent: Aug. 31, 2021

(54) EMERGENCY DOOR LOCK SYSTEM AND METHOD

(71) Applicant: Legacy Barricades, Inc., Grand Rapids, MI (US)

(72) Inventors: Hunter Seelbinder, Fenton, MI (US); Rick Kelch, Caledonia, MI (US); Debra Kelch, Caledonia, MI (US)

(73) Assignee: Legacy Barricades, Inc., Grand Rapids, MI (US)

( * ) Notice: Subject to any disclaimer, the term of this patent is extended or adjusted under 35 U.S.C. 154(b) by 144 days.

(21) Appl. No.: 16/545,545

(22) Filed: Aug. 20, 2019

(65) Prior Publication Data

US 2020/0063475 A1 Feb. 27, 2020

Related U.S. Application Data

(60) Provisional application No. 62/867,454, filed on Jun. 27, 2019, provisional application No. 62/722,433, filed on Aug. 24, 2018.

(51) Int. Cl.

| | |
|---|---|
| ***E05C 19/18*** | (2006.01) |
| ***G08B 21/02*** | (2006.01) |
| ***G08B 5/36*** | (2006.01) |
| ***E05C 1/04*** | (2006.01) |

(52) U.S. Cl.

CPC ..... *E05C 19/184* (2013.01); *E05C 1/04* (2013.01); *G08B 5/36* (2013.01); *G08B 21/02* (2013.01)

(58) Field of Classification Search

CPC ..... E05C 19/184

See application file for complete search history.

(56) References Cited

U.S. PATENT DOCUMENTS

| | | | | |
|---|---|---|---|---|
| 1,808,393 A | | 6/1931 | Wecker | |
| 1,944,382 A | | 1/1934 | Wecker | |
| 2,553,732 A | * | 5/1951 | Young | E05C 17/54 292/288 |
| 2,568,477 A | * | 9/1951 | Westlund | E05C 17/44 292/288 |
| D167,938 S | | 10/1952 | Grindstad | |
| 4,050,723 A | | 9/1977 | Papadatos | |
| 4,198,088 A | * | 4/1980 | Tochihara | E05C 19/18 292/288 |
| D272,041 S | | 1/1984 | Harris et al. | |

(Continued)

*Primary Examiner* — Travis R Hunnings

(74) *Attorney, Agent, or Firm* — Gardner, Linn, Burkhart & Ondersma LLP

(57) ABSTRACT

An emergency door lock system and method is provided for securing a door during an emergency situation. The emergency door lock system or barricade includes a portable removable lock pin, an interior door bracket, an exterior door bracket, and a set of u-shaped clamp brackets. The clamp brackets provide support to the interior bracket and the exterior bracket and a set of threaded screws through the clamp brackets provide pressure to the lock system to securely attach it to a door. The removable lock pin enters through a pin slot in the interior bracket and then engages into a remote pin slot in a floor or a wall. The lock pin engages the interior bracket and the remote pin slot to provide a secure robust lock or barricade with the door. The emergency door lock system is dissassembleable for removal for emergency access. An optional alarm system may be included.

18 Claims, 12 Drawing Sheets

(56) References Cited

U.S. PATENT DOCUMENTS 4,585,259 A * 4/1986 Vidas ..... E05C 17/54 16/82
5,398,982 A 3/1995 Watson, Jr.
5,454,143 A 10/1995 Wigley
5,454,610 A 10/1995 Taylor et al.
5,489,129 A 2/1996 Shepherd
5,590,918 A 1/1997 Kambalov
5,601,319 A 2/1997 Morin
5,983,680 A 11/1999 Del Nin
6,345,849 B1 * 2/2002 Yen ..... E05C 17/54 292/292
6,378,917 B1 * 4/2002 Jones ..... E05C 19/184 16/82
6,471,264 B1 10/2002 Ryan
6,708,625 B1 3/2004 Burke et al.
7,021,678 B1 * 4/2006 Raoult ..... A01K 1/0017 256/1
7,367,596 B2 5/2008 Leung
7,651,140 B2 1/2010 Leggio
D623,499 S 9/2010 Tien
D656,386 S 3/2012 Shen
8,690,201 B2 4/2014 Frazier
8,708,378 B2 * 4/2014 Frazier ..... E05B 63/20 292/137
D717,641 S 11/2014 Hugo
8,894,110 B2 11/2014 Taylor et al.
D722,495 S 2/2015 Hugo
D733,520 S 7/2015 Barna
9,121,203 B2 * 9/2015 Muramatsu ..... E05C 17/54
9,238,926 B2 1/2016 Guerrero et al.
9,388,620 B2 7/2016 Endo
9,518,421 B2 * 12/2016 Cushwa, Jr. ..... E05C 19/184
9,534,430 B2 1/2017 Taylor et al.
9,562,377 B2 * 2/2017 Attard ..... E05C 1/04
9,598,885 B2 3/2017 Yamamoto et al.
9,799,181 B2 * 10/2017 Cushwa, Jr. ..... G08B 5/36
9,856,682 B1 1/2018 Cook
9,863,172 B2 1/2018 Burke et al.
D813,642 S 3/2018 Tyus
9,957,741 B2 5/2018 Taylor et al.
10,094,154 B2 * 10/2018 Ploskunak ..... E05C 19/184
10,174,532 B2 * 1/2019 Couturier ..... E05C 19/184
D853,832 S * 7/2019 Cheever ..... E05C 19/184 D8/402
2008/0216524 A1 9/2008 Abdelazeem
2009/0058104 A1 * 3/2009 Huang ..... E05F 5/04 292/288
2011/0291426 A1 12/2011 Gibson
2014/0159384 A1 6/2014 Frazier
2014/0312634 A1 * 10/2014 Cushwa, Jr. ..... E05C 19/182 292/340
2015/0076844 A1 3/2015 Taylor et al.
2016/0230431 A1 8/2016 Yonekura
2017/0211301 A1 7/2017 Richmond

* cited by examiner

EMERGENCY DOOR LOCK SYSTEM AND METHOD

CROSS REFERENCE TO RELATED APPLICATION

The present application claims priority of U.S. provisional application Ser. No. 62/722,433 filed Aug. 24, 2018, and Ser. No. 62/867,454 filed Jun. 27, 2019, which are hereby incorporated herein by reference in their entireties.

FIELD OF THE INVENTION

The present invention is directed to door lock systems, and in particular to an emergency door lock system.

BACKGROUND OF THE INVENTION

Conventional door lock systems provide minimal security in lock down situations. Conventional door lock systems are often quickly breached or easily disabled from the outside of the door rendering them useless for impeding or stopping intruders.

SUMMARY OF THE INVENTION

The present invention provides a door lock or barricade system for securing or barricading a door in emergency situations, such as an active shooter situation, and a method for using the system. The door lock system may be used with an out-swing or outward swinging door or an in-swing or inward swinging door An interior clamp bracket, an exterior clamp bracket, and a set of u-shaped brackets define a clamp system to attach the lock system onto a door. A lock pin is inserted into a pin slot through the interior clamping bracket and engages with a remote pin slot to create a lock or barricade between the door and the remote pin slot. The lock pin is removable from the interior clamp bracket and is portable. The lock system is dissassembleable to be removed by emergency personnel in situations such as a fire.

In one form of the present invention, an emergency door lock system includes an interior door clamp bracket, and exterior door clamp bracket, a set of u-shaped brackets for supporting and clamping the interior and exterior bracket onto a door. The interior bracket including a pin slot for accepting and supporting a removably insertable lock pin. A plurality of threaded holes are disposed within at least one portion of each u-bracket such that a threaded fastener is threaded into each hole and tightened to apply pressure to the exterior clamp bracket creating a clamping force on the door between the interior bracket and the exterior bracket. The lock pin is configured to enter into and at least partially pass through the interior bracket and to simultaneously enter into and engage with a remote pin slot to lock or barricade between the lock system, door, and remote pin slot. The remote pin slot may be defined by a hole in a floor, a wall, a doorjamb, or the like. The lock system is configured to be disassembled to remove the lock system while the lock pin is engaged to allow emergency personnel to remove the lock system and enter through the door.

According to one aspect, the interior bracket is defined by a rigid plate material, such as a steel plate, having a back plate, an upper flange and a lower flange formed from one contiguous piece of plate material. The upper flange is disposed on the upper edge of the back plate and the lower flange is disposed on the lower edge of the back plate. A pin support hole is disposed through each of the upper flange and the lower flange. The pin support holes are configured to accept and engage the lock pin. The lock pin and the pin support holes may have one of several cross sections, such as a circle, a square, a rectangle, a slit, a triangle, a star, a t-shape, or the like, allowing for the lock pin to enter into and engage the pin support holes. A plurality of cutouts are defined by a space between the back plate and both the upper and the lower flange, each cutout is configured for accepting a portion of one of the u-bracket.

The exterior bracket is defined by a rigid plate material, such as a steel plate, having a back plate, an upper flange and a lower flange formed from one contiguous piece of plate material. The upper flange is disposed on the upper edge of the back plate and the lower flange is disposed on the lower edge of the back plate. A plurality of holes are disposed in the back plate such that a fastener may pass through each hole to engage the door. A plurality of cutouts are defined by a space between the back plate and the upper flange, each cutout is configured for accepting a portion of one of the u-bracket. A plurality of cutouts are defined by a space between the back plate and the lower flange, each cutout is configured for accepting a portion of one of the u-bracket.

The u-shaped brackets or u-brackets are each defined by a rigid material, such as steel, carbon fiber, or the like. The u-shaped bracket are formed from one contiguous piece of the rigid material. Each u-bracket is defined by a bottom portion and two leg portions, such that each leg portion is disposed at one of the ends of the bottom portion and extending perpendicularly from the bottom portion. The bottom portion of the u-shaped bracket has a thickness that is less than the space between the door and the adjacent surface, such as a floor, a wall, a doorjamb, or the like, such that the u-shaped bracket does not engage or contact the adjacent surface when the door lock system is mounted to the door. A plurality of threaded holes are disposed on at least one of the leg portions of the u-bracket such that a threaded fastener is disposed in each threaded hole. The u-brackets are configured to fit in the cutouts defined by the open space between either the interior bracket back plate and its flanges or the exterior bracket back plate and its flanges. The u-bracket legs having threaded holes are positioned on the exterior side of the door to interact and engage the exterior bracket.

The lock system clamp portions including the interior bracket, the exterior bracket, and the u-brackets coordinate to clamp onto and securely attach to the door, such as on the bottom or the side of the door. The threaded fasteners disposed in the u-bracket legs are tightened through the u-bracket threaded holes and apply pressure onto the back plate of the exterior bracket causing an opposite pressure to be applied between the opposite legs of the u-bracket and the back plate of the interior bracket. The pressure produced from the threaded fasteners provides a clamping force onto the door between the back plate of the interior bracket and the back plate of the exterior bracket, securing the lock system to the door.

In another embodiment, the threaded fasteners pass through a plurality of corresponding holes in the exterior bracket back plate and are threaded until the tips of the fasteners interact with the outer surface of the door such that a crimp is formed between the door surface and the tip of the threaded fastener.

In another embodiment, a floor plate having a hole defining a remote pin slot is disposed in a floor directly below the interior bracket when the lock system is attached to the door and the door is in a closed orientation. The remote pin slot is disposed at a location substantially vertically below the location of the pin slot of the interior bracket such that the lock pin is simultaneously entered through and engaged with the interior bracket and the floor plate. The lock pin and the remote pin slot may have one of several cross sections, such as a circle, a square, a rectangle, a slit, a triangle, a star, a t-shape, or the like, allowing for the lock pin to enter into and engage the remote pin slot.

In another embodiment, a lock pin floor sleeve having an interior hole at least larger in diameter than the outer diameter of the lock pin defines a remote pin slot that is disposed in a floor directly below the lock pin holes of the interior bracket when the lock system is attached to the door and the door is in a closed orientation.

In one embodiment, an interior cover is disposed over the interior bracket to conceal and protect the interior bracket. The interior cover removably attached to the interior bracket. The interior cover includes pin holes on the upper and lower portions to allow passage of the lock pin through the pin slot of the interior bracket. An exterior cover is disposed of the exterior bracket to conceal and protect the exterior bracket. The exterior cover is removably attached to the exterior bracket. The interior cover and the exterior cover are removable to provide access to installers or emergency personnel to disassemble and remove the emergency lock system. In an emergency situation, emergency personnel may remove the exterior cover to access the threaded the threaded fasteners disposed in the u-bracket legs. Emergency personnel may loosen or remove the threaded fasteners and therefore reduce or remove the clamping pressure on the door allowing the lock system clamp portions to disengage the door, the u-brackets may then be separated or slid sideways relative to the plane of the door such that the interior bracket is no longer engaged with the door. Thus, the interior bracket and the lock pin no longer impede opening the door.

In one embodiment, a lock removal tool is provided that is configured to assist emergency personnel in removing the lock system when the lock system is installed on a door that swings in toward the lock pin, wherein the look system would impede the door from opening unless the lock pin is disengaged from the floor. The lock removal tool includes a main shaft and at least one leg perpendicularly fixed to the main shaft, such that when the main shaft is rotated the perpendicular leg raises or lowers depending on the direction of rotation of the main shaft The perpendicular leg is configured to engage at least a portion of the interior bracket to lift the bracket and the lock pin away from the floor.

In an additional embodiment, the lock pin is removably mounted to a wall in proximity to the lock system to enable any individual to place the lock pin into the lock system to secure a door. Optionally, an alarm system is provided in proximity to the lock system and the lock pin is removably coupled to the alarm system, such that when the lock pin is removed from the alarm system an alert is emitted from the alarm system. The alert from the alarm system may be an audible alert from a speaker, a visual alert from a light source, or a combination of audible and visual alerts. The alert of the alarm system provides a deterrent from students or others from tampering with or taking the lock pin when there is no emergency situation. The alarm system is configured to operate on replaceable battery power. Optionally, the alarm system is hardwired into the building electricity supply for power.

The alarm system may utilize a commercially available alarm system activated by the removal of a pin, a key, a chain, or the like, wherein the lock pin is coupled to the pin of the commercially available alarm system. Commercially available examples of alarm systems that are suitable for the alarm system include the SABRE PA-01, PA-NBCF-01, or PA-RAINN-01 Personal Alarms.

In another embodiment, the alarm system includes an interior housing unit mounted on a wall on the interior side of the door and an exterior housing unit mounted on a wall on the exterior side of the door in proximity to the lock system. The components of the interior housing and the exterior housing are in wired communication by a wire passing through the wall. Preferably, the alert from the alarm system is programmable to disarm after a specified time of operation, such that emergency personnel are not exposed to extended periods of loud noises or bright lights, or such that an adequate amount of time has passed to ensure that emergency personnel are alerted by the alert. The alarm system including an interior and exterior housing provides useful benefits including a deterrent from students or others from tampering with or taking the lock pin, alerting emergency personnel of a potential emergency event, alerting emergency personal to the location of an emergency event, alerting emergency personnel if the room is secured, and additional benefits.

Therefore, the present invention provides an emergency lock system for easily securing or barricading a door during an emergency situation, such as an active shooter situation. The door lock system is configured to be robust for adequately securing a door and to be simple to operate for untrained or lightly trained users. The door lock system is configured to be dissassembleable and removable from the door by emergency response personnel for emergency access purposes.

These and other objects, advantages, purposes, and features of the present invention will become more apparent upon review of the following specification in conjunction with the drawings.

BRIEF DESCRIPTION OF THE DRAWINGS

FIGS. 13A and 13C depict views from the exterior side of the door, and FIGS. 13B and 13D depict views from the interior side of the door;

DESCRIPTION OF THE PREFERRED EMBODIMENTS

Figure 1:
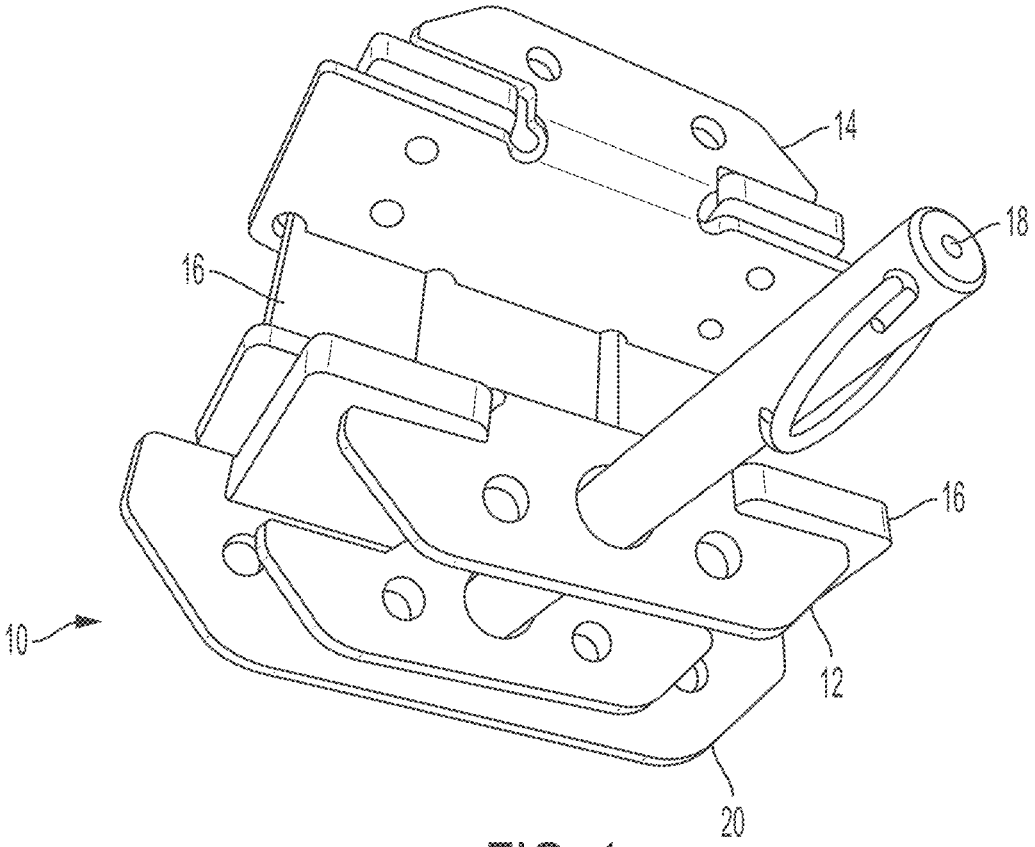
FIG. 1 is a perspective view of the emergency door lock system, according to the present invention.

Referring now to the drawings and the illustrative embodiments depicted therein, an emergency door lock system 10 provides a door lock or barricade system for use in lock down situations, such as an active shooter situation (FIG. 1). Door lock system 10 includes an interior door clamp bracket 12, and exterior door clamp bracket 14, at least two u-brackets 16, a lock pin 18, and a floor plate 20 to provide an emergency lock to quickly secure a door 22, including inswing and outswing doors, during an emergency event. Specifically, door lock system 10 is fitted to a door, such as a school classroom door, such that a user can quickly install the lock pin 18 into the lock system 10 to lock down a classroom. Door lock system 10 is able to be disassembled from the exterior of the door to allow emergency personal to remove the lock system 10 in the event that the user on the interior is unable to remove the lock pin 18. Preferably, the door lock system 10 mounts to a door 22 substantially without damaging or disfiguring the door 22.

Figure 2:
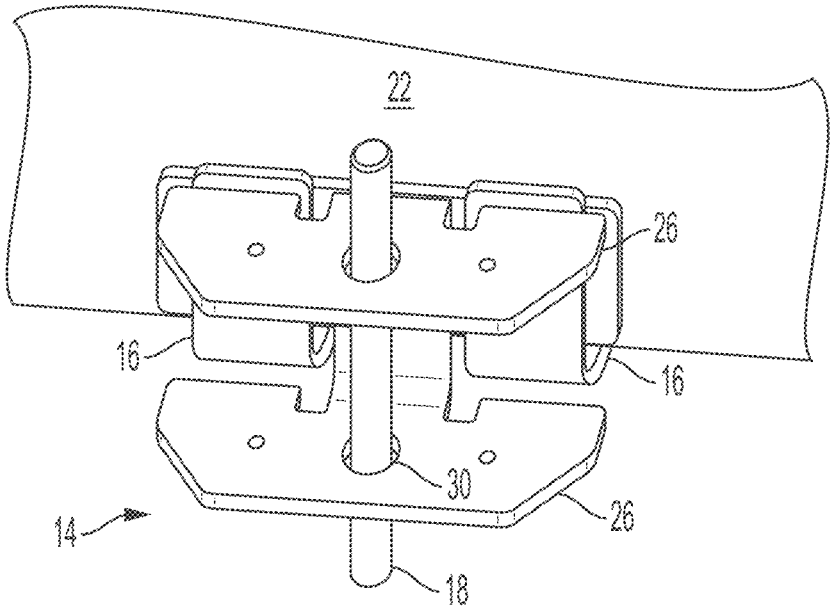
FIG. 2 is a perspective view of the interior side of the emergency door bracket attached to a door.

In the illustrated embodiments, the lock system 10 is removably mounted onto the door 22 with interior bracket 12, exterior bracket 14, and u-brackets 16. Interior bracket 12 is disposed on the interior side of door 22 while exterior bracket 14 is disposed on the exterior of door 22 (FIGS. 1 and 2). U-brackets 16 are positioned under the door 22 and married to respective brackets 12 and 14 on the interior and exterior of the door 22. Floor plate 20 is positioned and fixed to the floor beneath door 22 substantially respective to the position of the interior bracket 14 when the door is in a closed orientation such that lock pin 18 may engage the interior bracket 12 and the floor plate 20 simultaneously.

Figure 3:
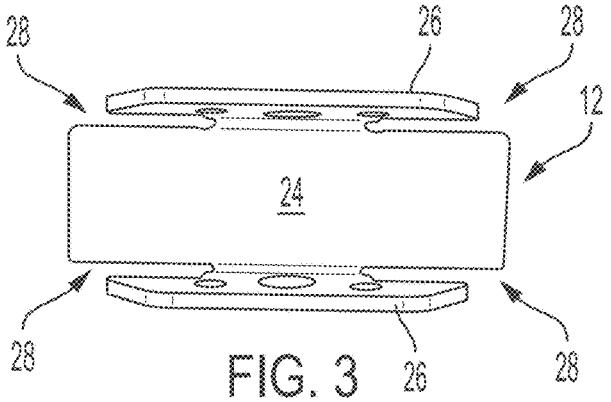
FIG. 3 is a perspective view of the interior lock pin side securing bracket of the emergency door lock system.

The interior bracket 12 includes back plate 24, two flange plates 26, and two lock pin holes 30 (FIGS. 2 and 3). Each flange plate 26 is perpendicularly fixedly connected to the back plate 24 on a transverse edge, such that the flange plates 26 are on opposite edges of the back plate 26. A plurality of cut-outs 28 are defined between the flange plates 26 and the back plate 24 to accept a portion of the u-bracket 16. A lock pin hole 30 is disposed in each of the flange plates 26 to allow the lock pin 18 to pass through each lock pin hole 30. The interior bracket 12 are constructed of a sufficiently rigid material, such as steel, aluminum, carbon fiber, or the like. The interior bracket 12 may be formed from a contiguous piece of material that is bent or cut to define the required shape.

Figure 4:
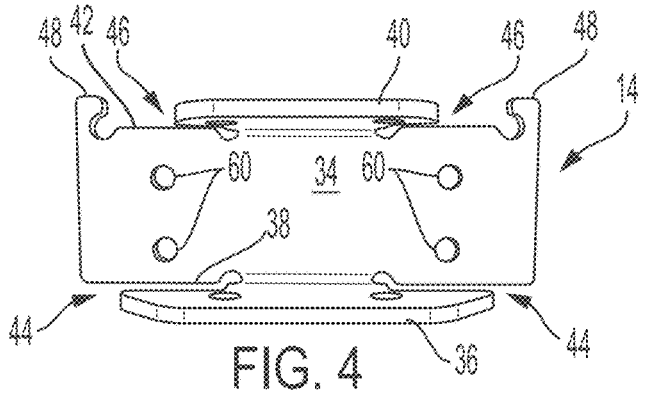
FIG. 4 is a perspective view of the exterior side securing bracket of the emergency door lock system.
Figure 6:
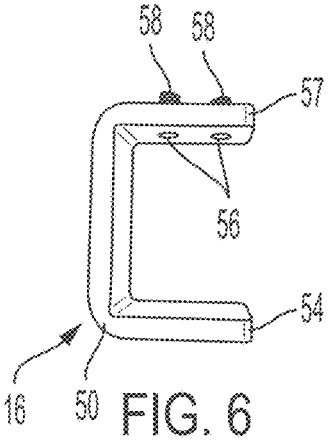
FIG. 6 is a perspective view of the side of one of the u-brackets of the emergency door lock system with screws threaded into threaded holes.

The exterior bracket 14 includes a back plate 34, a top flange plate 36, and a bottom flange plate 40 (FIG. 4). The top flange plate 36 is perpendicularly fixed on a top edge 38 of the back plate 34 and the bottom flange plate 40 is perpendicularly fixed on a bottom edge 42 of the back plate 34. A plurality of cut-outs 44 are defined between the top flange plate 36 and the back plate 34. A plurality of cut-outs 46 are defined between the bottom flange plate 40 and the back plate 34. Cut-outs 44 and 46 are configured to accept a portion of the u-bracket 16. Optionally, and as shown in FIG. 6, retaining tabs 48 are disposed on the extreme ends of the bottom edge 42 of the back plate 34 for retaining the u-brackets 16 during installation of the lock system 10 onto the door 22. The exterior bracket 14 are constructed of a sufficiently rigid material, such as steel, aluminum, carbon fiber, or the like. The exterior bracket 14 may be formed from a contiguous piece of material that is bent or cut to define the required shape.

Figure 5:
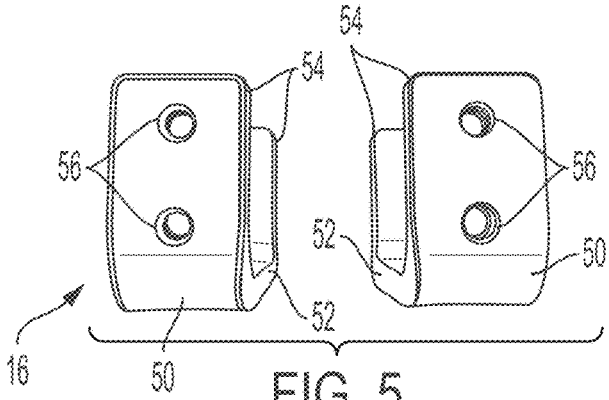
FIG. 5 is a perspective view of the u-brackets of the emergency door lock system.

The u-brackets 16 are each defined by a u-shaped angular member 50. The angular member 50 includes a lower portion 52 and two leg portions 54 (FIGS. 5 and 6). Each leg portion 54 extends perpendicular from one end of the lower portion 52. As shown in FIG. 1, each leg portion is configured to insert into the opening defined by cut-outs 28, 44, and 46 of the respective interior bracket 12 or exterior bracket 14. The u-brackets 16 are constructed of a sufficiently rigid material, such as steel, aluminum, carbon fiber, or the like. The exterior bracket 14 may be formed from a contiguous piece of material that is bent or cut to define the required shape.

A plurality of threaded holes 56 are disposed in at least one of the leg portions 54. A mechanical fastener, such as a threaded screw 58 is threaded into each of the threaded holes 56 (FIGS. 5 and 6). The threaded screws 58 are mechanically operable to apply pressure to the back plate 34 of exterior bracket 14 to create a clamping force on the door 22 between the exterior bracket 14 and the interior bracket 12 to secure the lock system 10 onto the door 22. The threaded screw 58 may be a set screw type fastener. Preferably, the threaded screw 58 is a flat tip screw.

Figure 7:
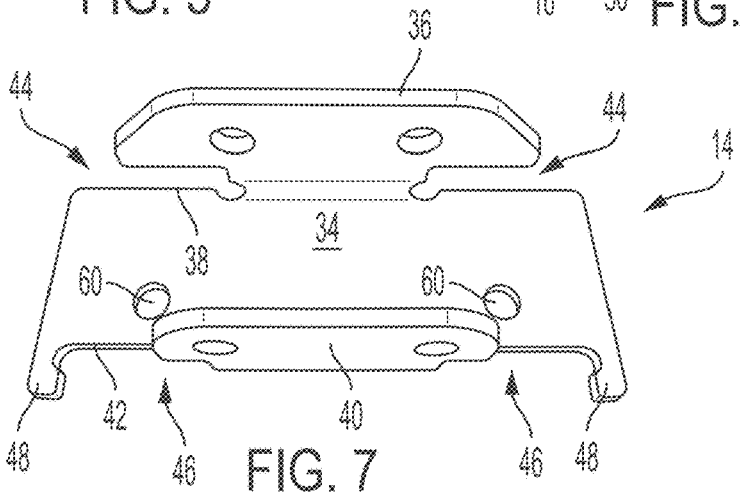
FIG. 7 is a perspective view of the exterior side securing bracket of the emergency door lock system.

Optionally, as illustrated in FIGS. 4 and 7, a plurality of holes 60 are disposed in the back plate 34 of the exterior bracket 14 substantially relative to the location of the threaded holes 56 in the u-bracket 16. Each hole 60 allows the threaded screw 58 to pass through the back plate 34 and contact the door 22 to further secure the lock system 10 to the door 22. Preferably, the threaded screw 58 interacts with the outer surface or "skin" of the door, such that a crimp, indentation, divot, or the like is formed in the door 22 material from the tip of the threaded screw 58. Optionally, the threaded screw 58 pierces the door 22 "skin" such that the threaded screw 58 penetrates the "skin" of the door 22 such that the threads of the threaded screw 58 internally engages the door 22.

Figure 9:
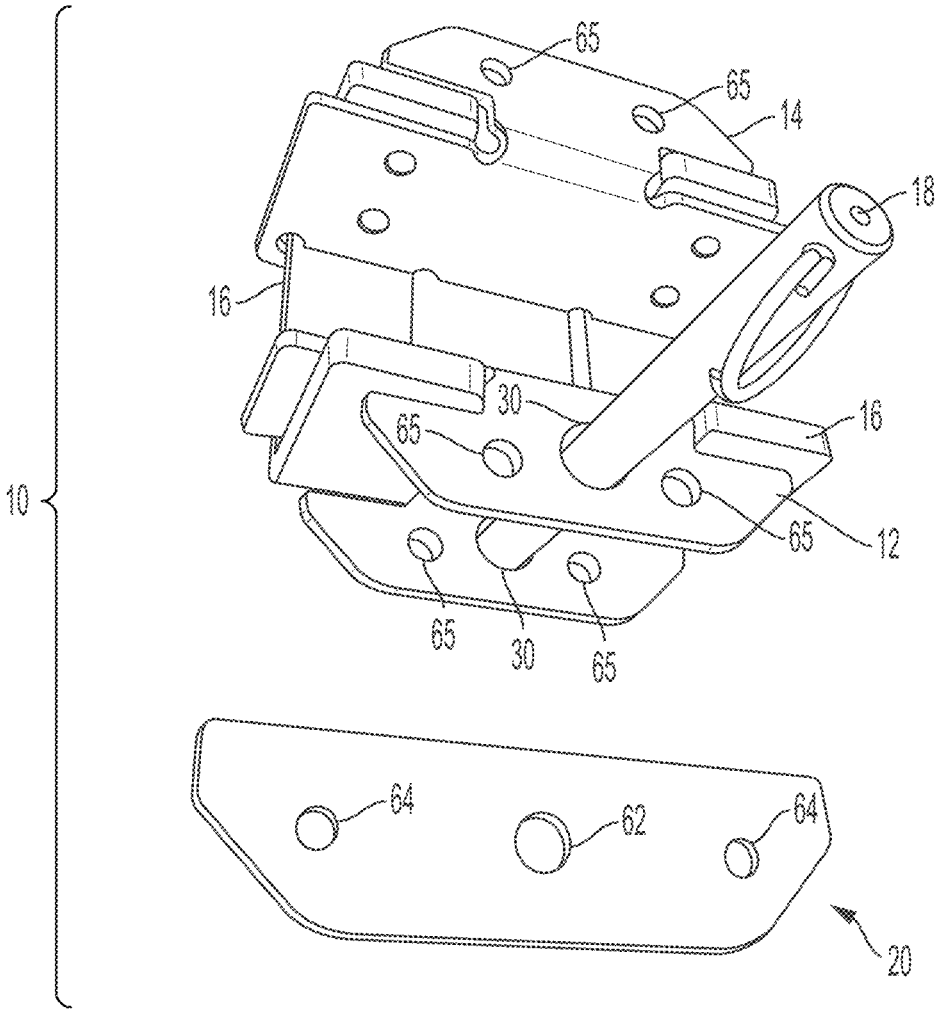
FIG. 9 is a perspective view of the emergency door lock system separated from the floor plate.

In one embodiment, the floor plate 20 includes a hole defining a remote floor pin hole or pin slot 62 and a plurality of anchor holes 64 (FIG. 9). The floor plate is configured to be disposed on the floor underneath the door 22 corresponding to the position of the portion of the lock system 10 mounted on the door 22. The location of the floor pin hole 62 is positioned such that when the door 22 is in the closed position the lock pin 18 is inserted through lock pin holes 30 of the interior bracket 12 and passes through the floor pin hole 62 to secure the door 22 in a closed position. In the event of emergency, a user, carrying or possessing the portable lock pin 18, inserts the lock pin through the interior bracket 12 and into the floor pin hole 62 to engage the interior bracket 12 and the floor pin hole 62 forming a lock or barricade for the door 22 to provide deterrence to a would be intruder.

In another embodiment, a lock pin floor sleeve 172 having an interior hole 174 at least larger in diameter than the outer diameter of the lock pin 18 is fixedly disposed in the floor at a position such that when the door 22 is in the closed position the lock pin 18 is inserted through lock pin holes 30 of the interior bracket 12 and passes through the floor pin sleeve 174 to secure the door 22 in a closed position. The floor sleeve 172 includes a pin shaft 175 extending downward concentric to the interior hole 174, such that the lock pin 18 is insertable into a pin shaft 175 of the floor sleeve 172 that is embedded into the floor.

Optionally, the lock pin 18, the lock pin hole 30, and the floor pin hole 62 may be defined by a cross section other than the circular cross section shown, such as a square, a rectangle, a slit, a triangle, a star, a t-shape, or the like, while allowing the lock pin 18 to enter into and through the lock pin hole 30 and to enter into and to engage the floor pin hole 62. In the embodiment illustrated in FIGS. 1 and 2, lock pin 18 has a uniform cross section along its entire length. Optionally, lock pin 18 may have a generally uniform cross section along an operative region, such as the region that slides into floor pin hole 62, and another generally uniform cross section of different size or configuration along a different operative region, such as the region that slides within lock pin holes 30. A knob, handle, ring or other grasping element may be included on lock pin 18 above the generally uniform cross section region. Additionally, a slot and groove system may be used to engage the interior bracket 12 with a remote location such as a floor, a wall, a doorjamb, or the like.

The lock system 10 is disassembleable and removable to provide emergency access to emergency personnel in situations such as a fire. Emergency personal may remove or loosen the threaded screws 58, thus decreasing or eliminating the clamping force between the lock system 10 and the door 22. After the clamping force is decreased or eliminated, a user may slide the u-brackets 16 outward from the interior bracket 12 and the exterior bracket 14. When slid outward relative to the interior bracket 12 and exterior bracket 14 the u-brackets 16 disengage the brackets 12 and 14, thus eliminating any clamping force, clamping action, or engagement between the interior bracket 12 and the door 22. Once the interior bracket 12 is disengaged from the door emergency personnel may then open the door without an impediment caused by the lock pin 18 engaging the floor pin hole 62.

Figure 12:
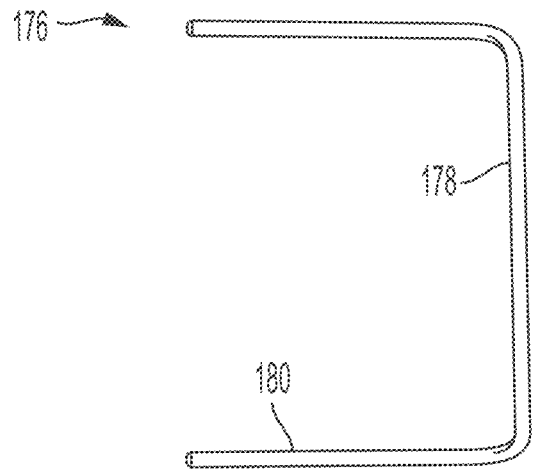
FIG. 12 is a perspective view of a lock pin removal tool of the emergency door lock system.
Figure 13A:
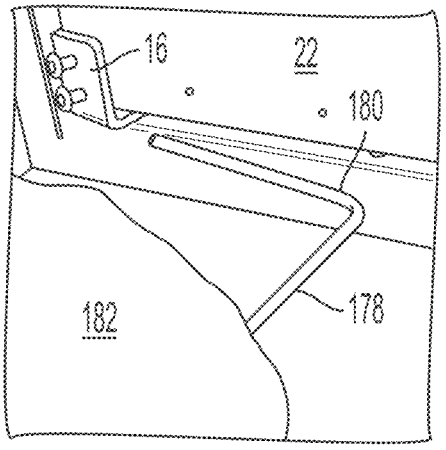
FIGS. 13A-13D are perspective views of an emergency personnel disassembling the lock system, depicting sequential steps of using the lock pin removal tool to remove the lock pin located on the interior side of the door.
Figure 13B:
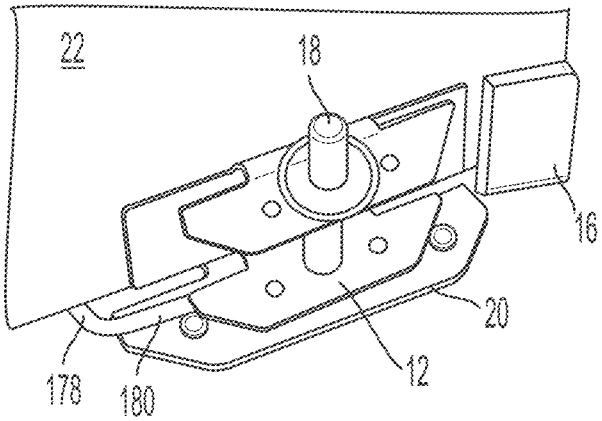
Figure 13C:
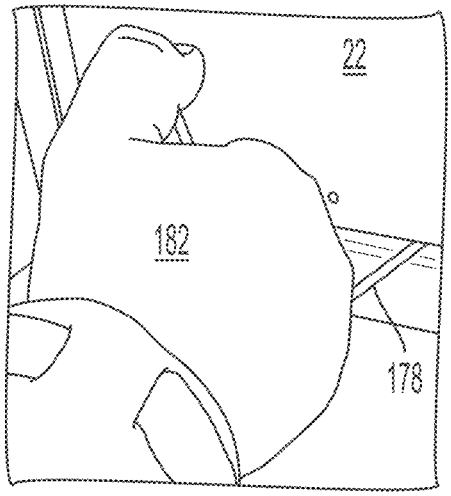
Figure 13D:
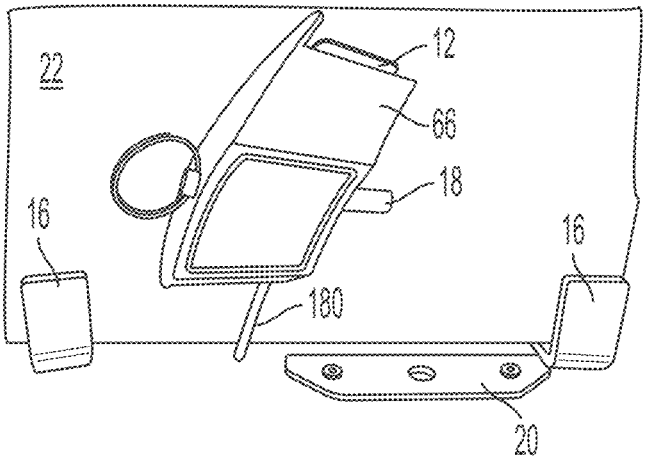

Optionally, a lock or lock pin removal tool 176, such as illustrated in FIG. 12, is configured to assist emergency personnel in removing the lock system 10 when the lock system 10 is installed on a door 22 that swings in toward the lock pin 18, wherein the look system 10 would impede the door 22 from opening unless the lock pin 18 is disengaged from the floor. The lock removal tool includes a main shaft 178 and at least one leg 180 perpendicularly fixed to the main shaft 178. Preferably, the lock removal tool 176 is formed from a single elongated piece of material with a perpendicular bend between the main shaft 178 and the at least one leg 180. As illustrated in FIGS. 13A and 13C, after sliding the u-brackets 16 outward, an emergency personnel 182, from the exterior of the door, inserts the lock removal tool 176 between the door 22 and the floor toward the lock pin 18 on the interior of the door 22. Once the leg 180 is clear of the interior face of the door 22, the emergency personnel 182 turns the main shaft 178 to lift the leg 180, as such lifting the interior bracket 12 and lock pin 18 out of the floor. As illustrated in FIGS. 13B and 13D, the lock removal tool 176 is inserted under the door until the leg 180 is clear of the interior face of the door, the emergency personnel 182 turns the main shaft 178, wherein the leg 180 lifts the interior bracket 12 and the lock pin 18 out of the floor, allowing the door 22 to open inward.

Figure 8:
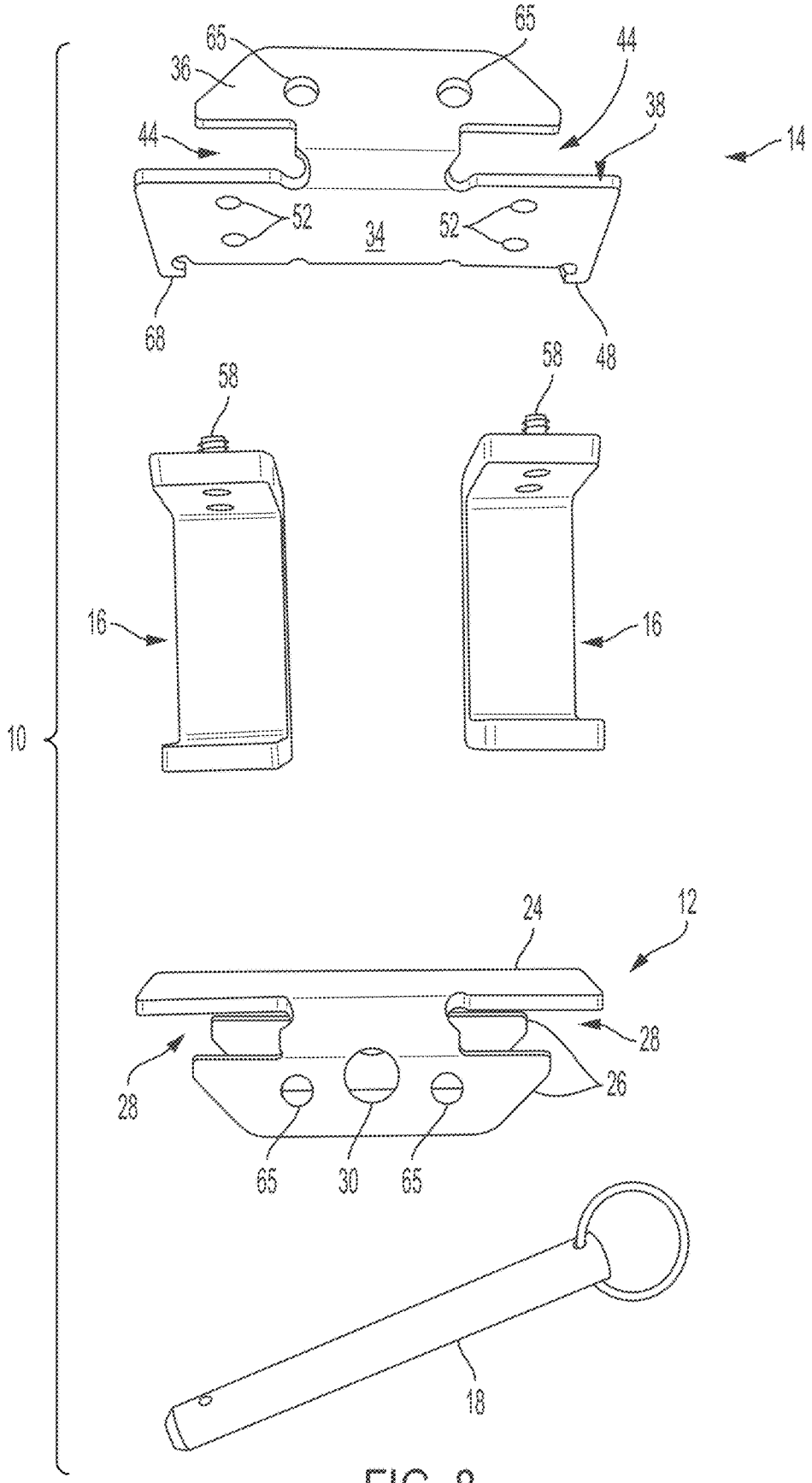
FIG. 8 is an exploded perspective view of the emergency door lock system.
Figure 10:
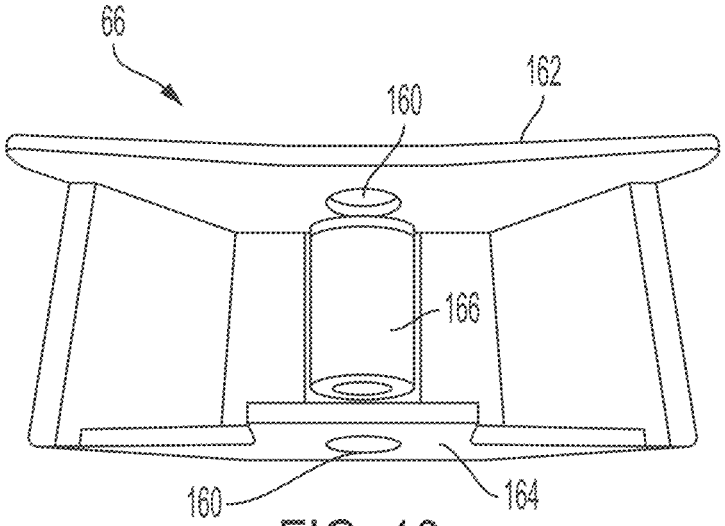
FIG. 10 is a perspective view of the interior of the exterior concealing beauty cover including a lock pin guide sleeve.
Figure 11:
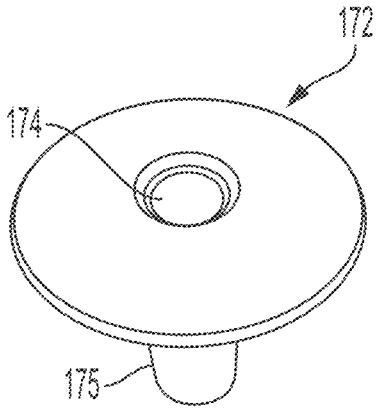
FIG. 11 is a perspective view of a lock pin floor sleeve of the emergency door lock system.

In one embodiment, a plurality of holes 65 are disposed in flange plates 26, 36, and 40 to accept and secure an interior concealing beauty cover 66 and an exterior concealing beauty cover (not shown) (FIGS. 8-10). The interior cover 66 and exterior cover are configured to provide a deterrent to vandalism and tampering with the lock system 10 and as an aesthetic covering over the interior bracket 12 and the exterior bracket 14. The exterior cover may be removed by emergency response personnel during emergencies, such as a fire, to access the threaded screws 58 in order to remove the lock system 10 from the door 22. The interior cover 66 includes a hole 160 on both the top side 162 and the bottom side 164 of the beauty cover 66 to allow the lock pin 18 to pass through the beauty cover 66, through the lock pin holes 30 on the flange plates 26 and into the floor or the floor pin hole 62. Optionally, the interior cover 66 includes a guide sleeve 166 disposed on the interior of the body of the interior beauty cover 66 to guide the lock pin 18 between the lock pin holes 30 as the operator is inserting the lock pin 18 into the door lock system 10.

Figure 14:
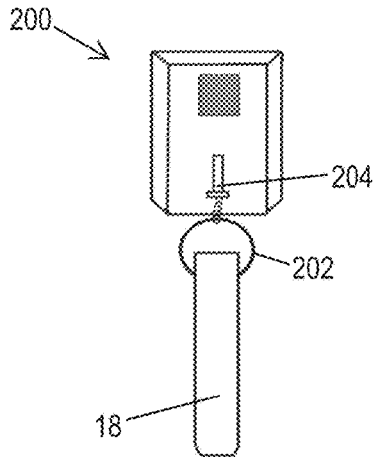
FIG. 14 is a perspective view of an interior alarm system coupled with the lock pin for use with the emergency door lock system.
Figure 20:
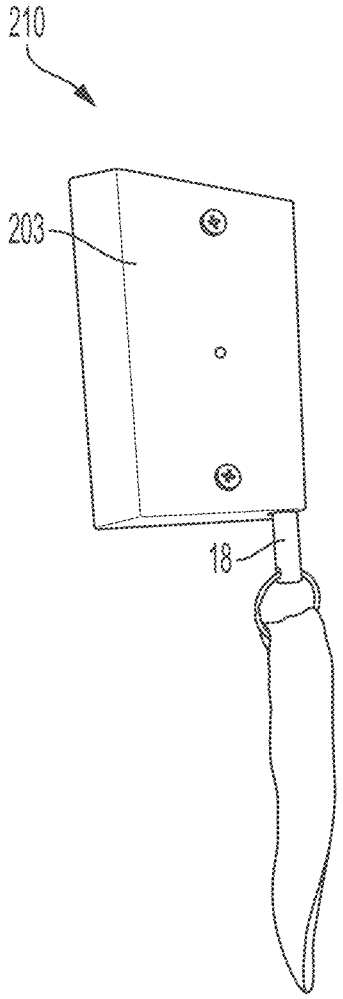
FIG. 20 is a perspective view of an alarm system coupled with a lock pin in accordance with the present invention.
Figure 21:
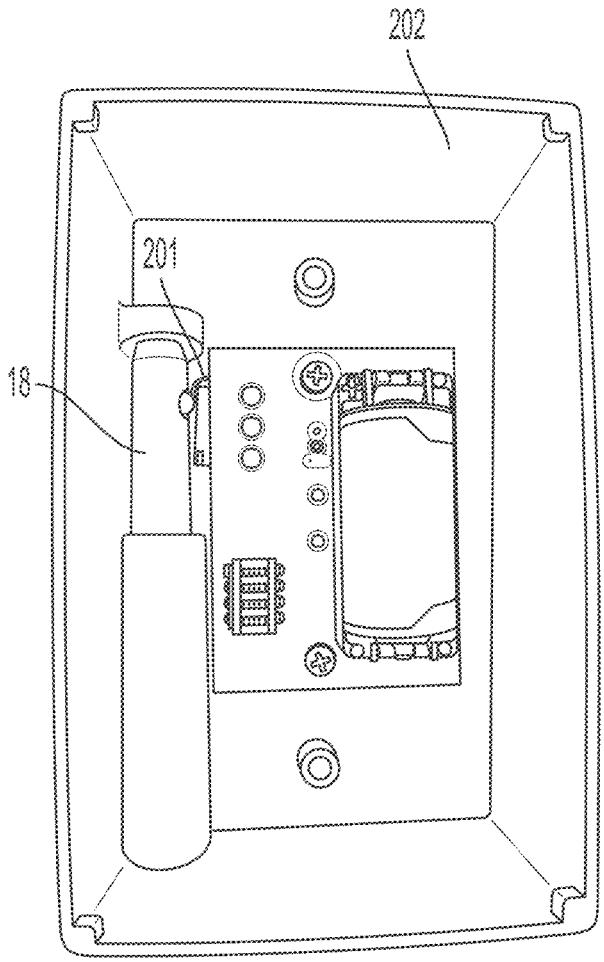
FIG. 21 is a perspective view of an interior of the alarm system of FIG. 20.

In one embodiment, an alarm system 200 is disposed in proximity with the lock system 10 wherein the lock pin 18 is removably supported by a housing 202 of the alarm system 200, and the alarm system 200 is configured to emit an alert from the interior side of the door 22 if the pin 18 is removed from the alarm system 200. (FIGS. 14 and 20) The housing 202 is mounted on a wall on the interior side of the door 22 in proximity to the lock system 200. The alarm system 200 may include a pressure sensitive switch 201 that is toggled during insertion and removal of the lock pin 18 from the housing 202, such that when the pin 18 is inserted in the housing 202, the switch 201 is toggled off and the alarm 200 is deactivated (FIG. 21). When the pin 18 is removed from the housing 202, the switch 201 is toggled on and the alarm 200 is activated. The alert from the alarm system 200 may be an audible alert from a speaker 204, a visual alert from a light source, or a combination of audible and visual alerts. As will be appreciated, the alert of alarm system 200 provides a deterrent from students or others from tampering with or taking the lock pin 18 when there is no emergency situation. A lock pin 18 coupled to an alarm system 200 at every door having a lock system 10 installed allows any individual to secure the door in an emergency situation, instead of only those who may me carrying a lock pin 18 on their person. The alarm system 200 is configured to operate on replaceable battery power. Optionally, the alarm system 200 is hardwired into the building electricity supply for power.

Optionally, the alarm system 200 utilizes a commercially available alarm system activated by the removal of a pin, a key, a chain, or the like, wherein the lock pin 18 is coupled to the pin of the commercially available alarm system. Commercially available examples of alarm systems that are suitable for alarm system 200 include the SABRE PA-01, PA-NBCF-01, or PA-RAINN-01 Personal Alarms.

Figure 15:
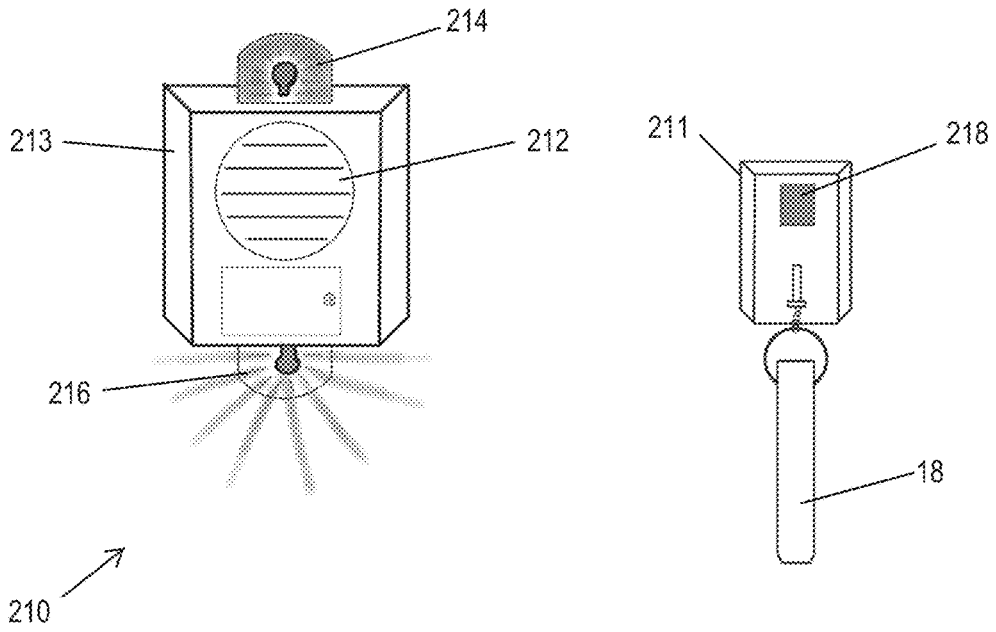
FIG. 15 is a perspective view of an alarm system coupled with the lock pin for use with the emergency door lock system including an exterior unit and an interior unit.
Figure 16:
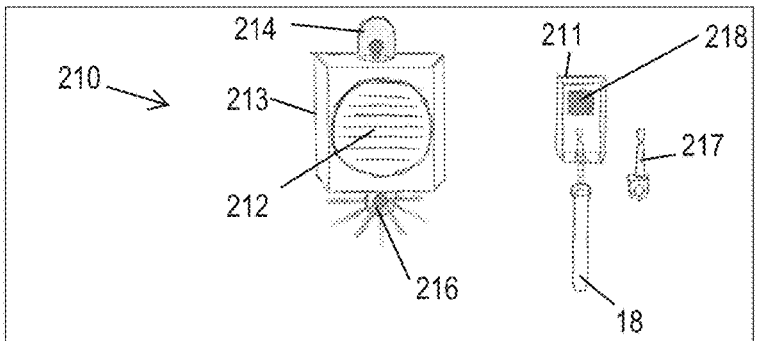
FIG. 16 is another perspective view of the alarm system of FIG. 15 including an actuation key for arming and disarming the alarm system.
Figure 24:
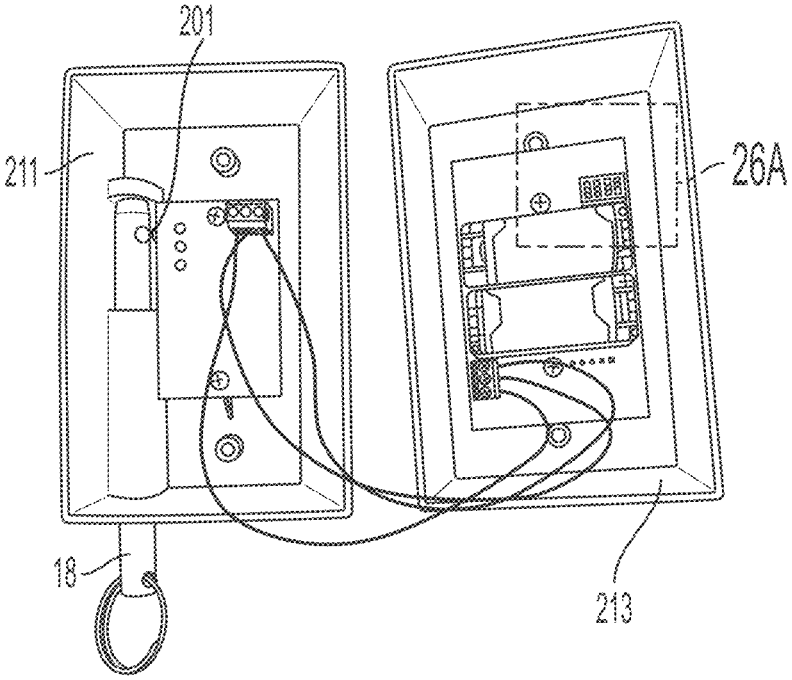
FIG. 24 is a perspective view of an interior of the alarm system of FIG. 22.
Figure 24A:
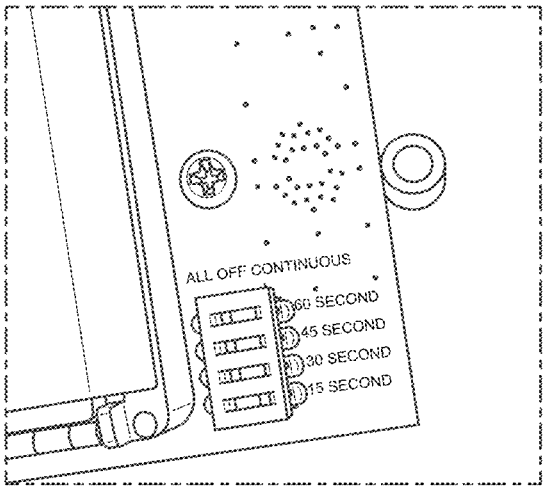
FIG. 24A is an enlarged view of the region designated 24A in FIG. 24.
Figure 25:
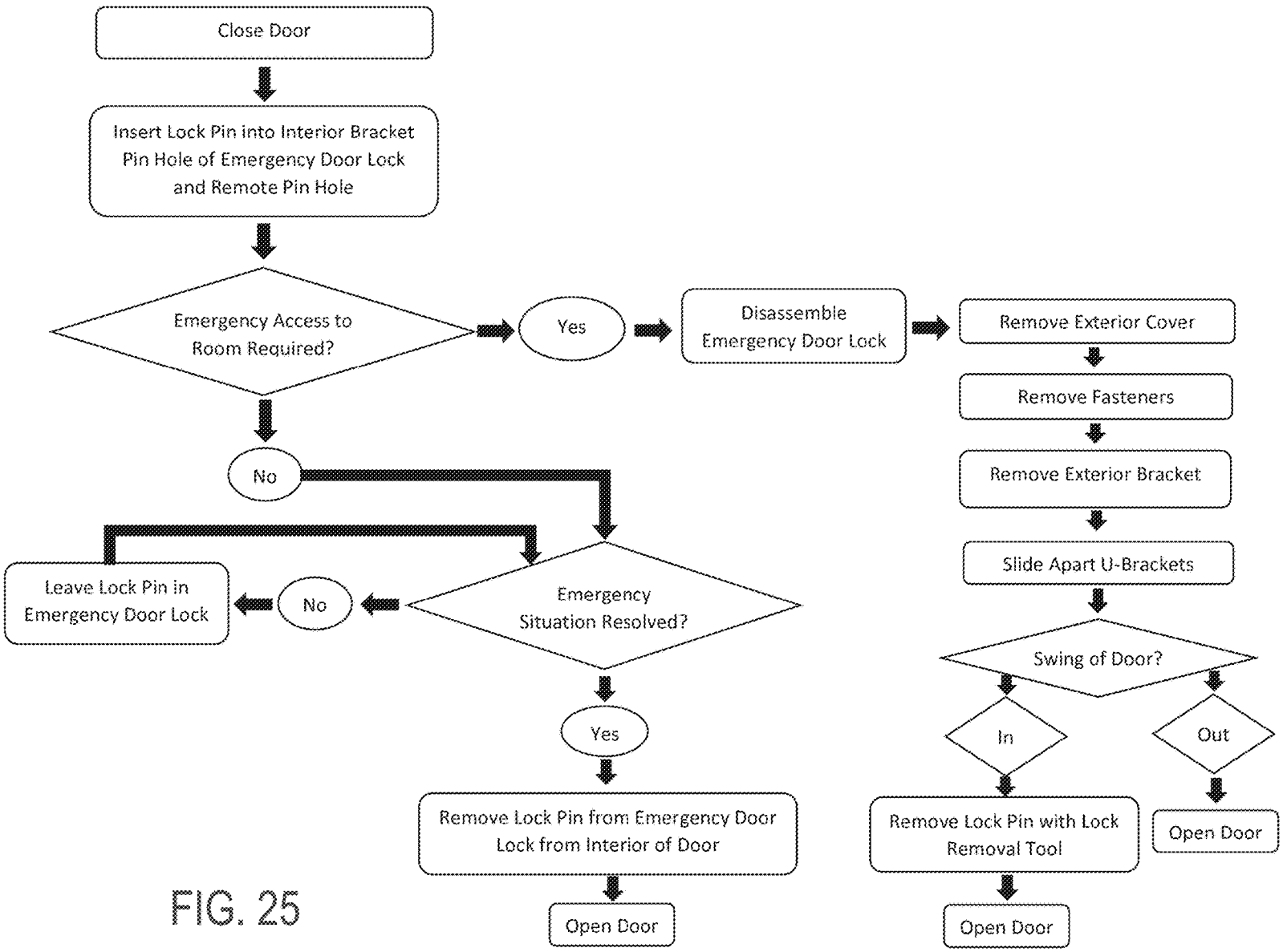
FIG. 25 is a block diagram of a method for securing a door in accordance with the present invention.

In another embodiment, as illustrated in FIGS. 15-16, 18-19B, and 22-24, an alarm system 210 is disposed in proximity with the lock system 10 wherein the lock pin 18 is removably supported by an interior housing 211 of the alarm system 210, and the alarm system 210 is configured to create an alert from an exterior housing 213 if the pin 18 is removed from the alarm system 210. (FIGS. 15-16). The alarm system 210 may include a pressure sensitive switch 201 that is toggled during insertion and removal of the lock pin 18 from the interior housing 211, such that when the pin 18 is inserted in the interior housing 211, the switch 201 is toggled off and the alarm 210 is deactivated (FIG. 24). When the pin 18 is removed from the interior housing 211, the switch 201 is toggled on and the alarm 210 is activated. The interior housing 211 is mounted on a wall on the interior side of the door 22 and the exterior housing 213 is mounted on a wall on the exterior side of the door 22 in proximity to the lock system 210. The components disposed on the interior housing 211 are in communication with the components disposed on the exterior housing 213 by a wire 215 passing through the wall. (FIGS. 18-19B) The alert from the alarm system 210 may be an audible alert from a speaker 212, visual alert from a light source 214, or a combination of audible and visual alerts, wherein the speaker 212, the light 214, or both, are disposed on the exterior housing 213. Preferably, the alert from the alarm system 210 is programmable to disarm after a specified time of operation, such that emergency personnel are not exposed to extended periods of loud noises or bright lights, or such that an adequate amount of time has passed to ensure that emergency personnel are alerted by the alert (see FIG. 24A).

Optionally, the alarm system 210 utilizes a commercially available alarm system activated by the removal of a pin, a key, a chain, or the like, wherein the lock pin 18 is coupled to the pin of the commercially available alarm system which is disposed on the interior housing 211. Commercially available examples of alarm systems that are suitable for alarm system 210 include the SABRE PA-01, PA-NBCF-01, or PA-RAINN-01 Personal Alarms.

As will be appreciated, the alert of alarm system 210 provides useful benefits including a deterrent from students or others from tampering with or taking the lock pin 18, alerting emergency personnel of a potential emergency event, a possible location of an emergency event, alerting emergency personnel if the room is secured, and additional benefits. A lock pin 18 coupled to an alarm system 210 at every door having a lock system 10 installed allows any individual to secure the door in an emergency situation, instead of only those who may me carrying a lock pin 18 on their person. The alarm system 210 is configured to operate on replaceable battery power. The alarm system 210 may be hardwired into the building electricity supply for power. Optionally, the alarm system 210 includes an actuation key 217 configured to arm or disarm the alarm system 210.

Figure 22:
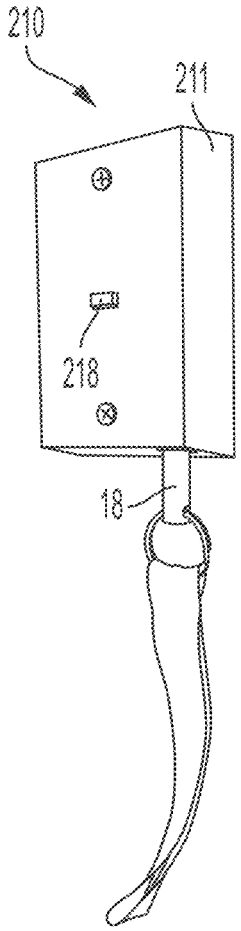
FIG. 22 is a perspective view of another alarm system coupled with a lock pin in accordance with the present invention.
Figure 23A:
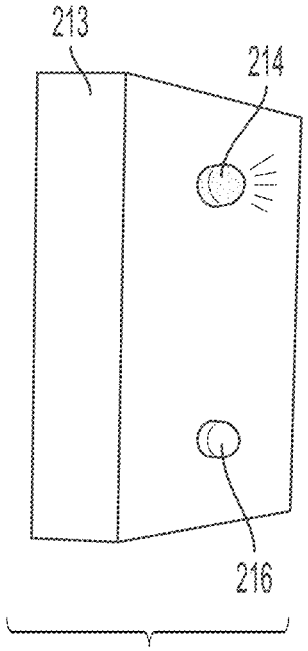
FIG. 23A is a perspective view of exterior side alert lights of the alarm system of FIG. 22.
Figure 23B:
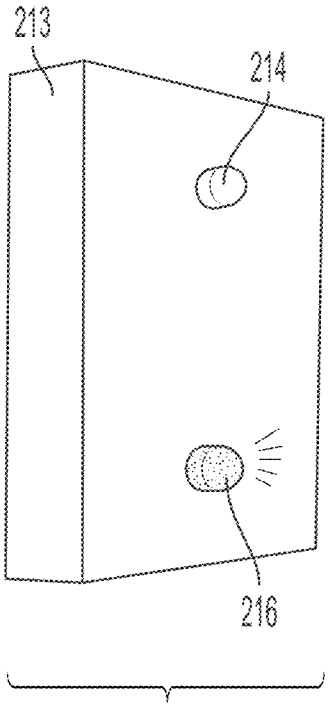
FIG. 23B is another perspective view of the exterior side alert lights of the alarm system of FIG. 22.

In the illustrated embodiment of FIGS. 15-17, 23A, and 23B, alarm system 210 includes an additional alert light 216 configured to alert emergency personnel of the exact room or location where an emergency situation is occurring. The additional alert light 216 is disposed on the exterior housing 213 and is configured to be manually operated by a button or switch 218 disposed on the interior housing 211 by an operator on the interior side of the door 22 (FIGS. 16 and 22). Optionally, the additional alert light 216 is only operable using the button 218 if the lock pin 18 has been removed from the interior housing 211.

Figure 17:
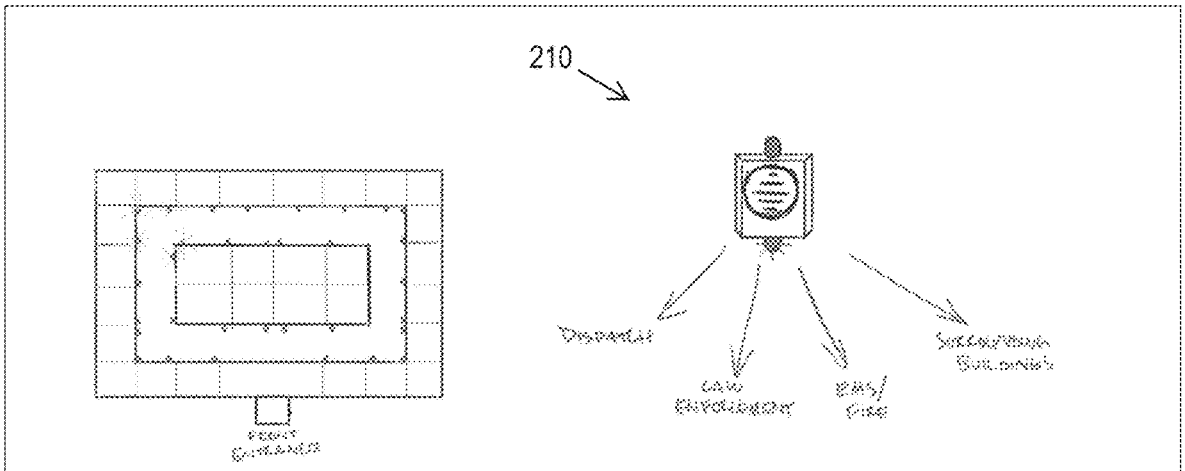
FIG. 17 is a perspective view of the alarm system of FIG. 15, including an audible sensor for detecting specific audible events.
Figure 18:
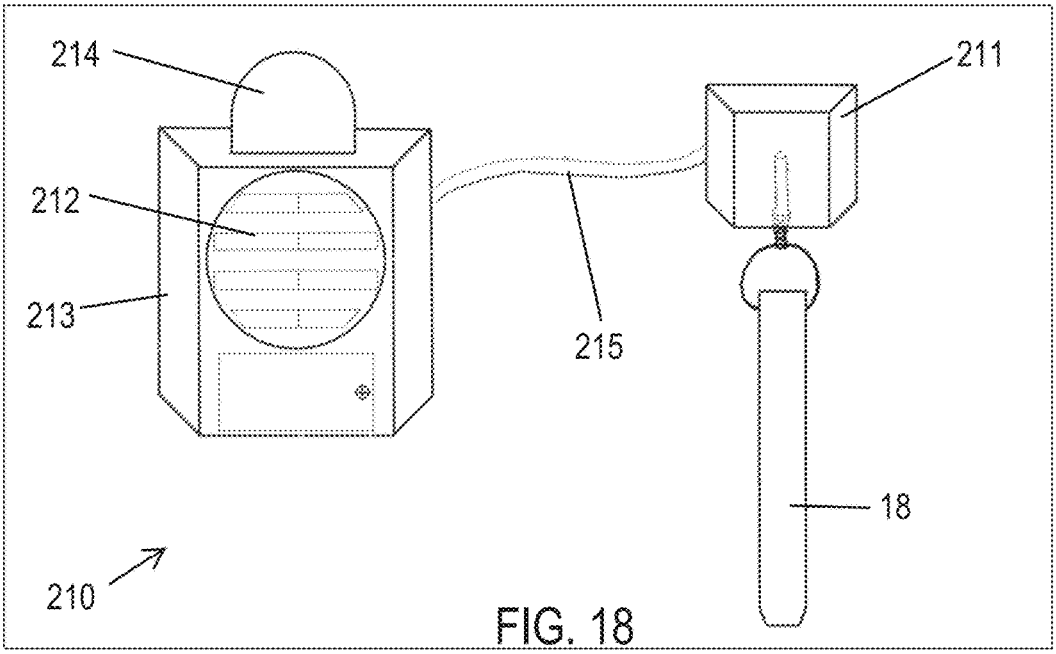
FIG. 18 is another perspective view of the alarm system of FIG. 15.
Figure 19A:
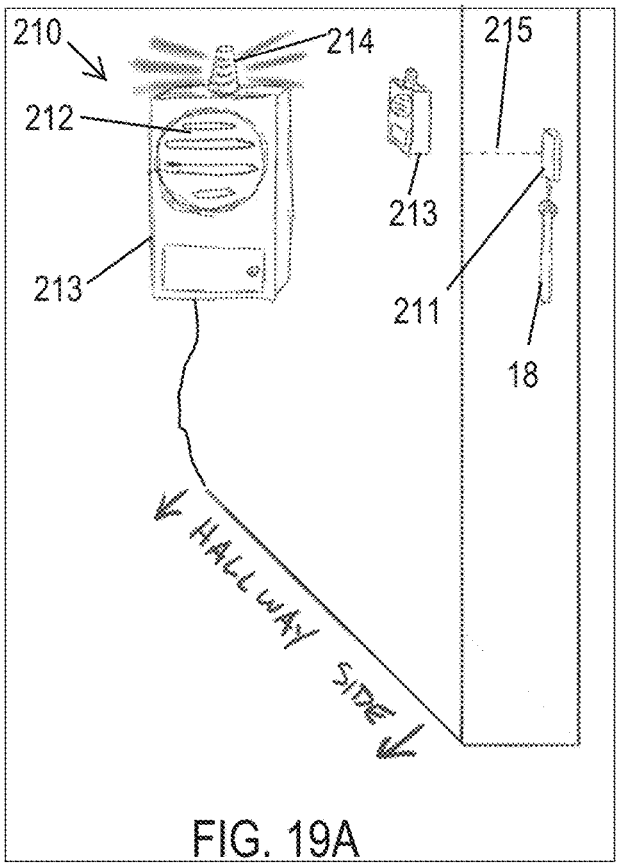
FIGS. 19A-19B are perspective views of the alarm system of FIG. 15 as viewed from an exterior, hallway side, of a door, and an interior, classroom side, of a door, respectively.
Figure 19B:
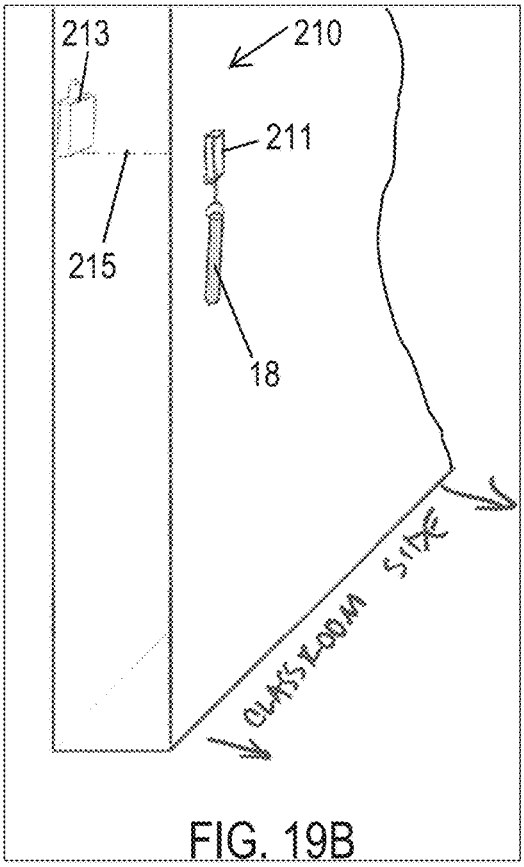

In yet another embodiment, as illustrated in FIG. 17, alarm system 210 includes an audibly activated sensor or sonar sensor, not shown, configured to detect specific audible signals in response to an audible event, such as a specific decibel range of a gun firing, such that the audible event activates the alert of the alarm system 210. The audibly activated system automatically activates the alerts of the alarm system 210 whether or not the lock pin 18 has been removed from the interior housing 211. Optionally, the alarm system 210 including the audibly activated sensor further includes a transponder configured to send a signal to a control system to provide location information to the control system based on the alarm system 210 nearest in proximity to the audible event.

In one embodiment, a method 310 for securing a door during an emergency event includes closing 312 a door 22, the door 22 having an emergency door lock system 10 removeably mounted on the door 22, inserting 314 a lock pin 18 into a lock pin hole 30 on a portion of the emergency door lock system 10 on the interior side of the door 22 after the door 22 has been closed, the lock pin 18 engaging the emergency door lock system 10 mounted on the door 22 and engaging a remote pin slot 62 remotely spaced adjacent the emergency door lock system 10 mounted on the door 22. The lock pin 18 remains in place until the emergency situation has been resolved. At such time, the method 310 includes removing 316 the lock pin 18 to allow the door 22 to be opened.

In one aspect, the method for securing a door during an emergency event 310 further includes disassembling 318 the emergency door lock 10 from an exterior side of the door 22 if emergency access to the room is required, including removing 320 an exterior cover, removing 322 a plurality mechanical fasteners 58 from an exterior bracket 14, if necessary, removing 324 the exterior bracket 14, and sliding 326 u-brackets 16 apart from each other and away from the interior bracket 12. If the emergency door lock system 10 is mounted on an out-swinging door, the door 22 can then be opened to gain access to the room. If the emergency door lock system 10 is mounted on an in-swinging door, the method 310 includes removing 328 the lock pin 18 from the exterior of the door 22 from underneath the door 22 with a lock pin removal tool 176. Once the lock pin 18 has been removed, the in-swinging door can be opened to access the room.

Accordingly, the emergency door lock system provides a simple system for securing a door, including inswing and outswing doors, during a lock down situation, for instance during an active shooter situation. An interior bracket on the interior of a door and an exterior bracket on the exterior of the door are disposed between a set of u-shaped brackets. The u-shaped brackets include a set of set-screws that are tightened to produce a pressure of the exterior bracket and thus create a clamping force between the interior bracket and the exterior bracket to secure the lock system onto the door. The interior bracket includes a set of lock pin holes for accepting and engaging a lock pin. Optionally, a floor plate or sleeve is disposed on the floor below the interior bracket with a floor pin hole located directly below the lock pin holes of the interior bracket such that the lock pin can be entered into the interior bracket and through the floor plate to secure the door in a closed orientation. Engagement of the lock pin through the lock pin holes and floor pin hole provides a substantial deterrent to the unwanted entry through a door during an emergency situation. Optionally, the lock pin is removably coupled to an alarm system in proximity to the door lock system, such that the lock pin is always in proximity to the lock system and that individuals are deterred from tampering with or removing the lock pin in non-emergency situations. The alarm system is configurable to alert emergency personnel of an ongoing emergency situation or the specific location of a current or resolved emergency situation.

Changes and modifications in the specifically described embodiments can be carried out without departing from the principles of the present invention, which is intended to be limited only by the scope of the appended claims, as interpreted according to the principles of patent law, including the doctrine of equivalents.

The embodiments of the invention in which an exclusive property is claimed are defined as follows:

1. An emergency door lock system, comprising:

an insertable lock pin;

an interior clamp bracket;

an exterior clamp bracket; and a plurality of u-brackets;

wherein said interior clamp bracket is configured to contact against an interior of a door, said exterior clamp bracket is configured to contact against an exterior of the door, and said plurality of u-brackets support, secure, and provide a clamping force to said interior and exterior clamp bracket to secure the door lock system on the door, wherein the clamping force is provided by a plurality of threaded fasteners disposed in a plurality of threaded holes through at least one portion of said u-brackets;

wherein said interior clamp bracket further comprises a bracket pin slot configured to accept said lock pin and allow said lock pin to pass through said bracket pin slot;

wherein said lock pin is configured to engage said interior clamp bracket through said bracket pin slot and simultaneously engage a remote pin slot to secure the door in a closed position, said remote pin slot remotely spaced adjacent to said interior clamp bracket;

wherein said plurality of u-brackets are removably fastened to said exterior clamp bracket such that said door lock system is dissassembleable and removable from the door for emergency removal.

2. The emergency door lock system of claim 1, wherein said u-brackets are removably fastened to said exterior clamp bracket by at least some of said plurality of threaded fasteners comprising a plurality of threaded screws.

3. The emergency door lock system of claim 1, wherein said lock pin comprises an elongate rod having a uniform cross section.

4. The emergency door lock system of claim 3, wherein a grip is disposed at one end of said lock pin.

5. The emergency door lock system of claim 1, wherein said interior clamp bracket is defined by a steel plate having an upper flange and a lower flange disposed on opposing edges of said plate, said flanges each including a vertical pin hole such that said pin holes define said bracket pin slot.

6. The emergency door lock system of claim 1, wherein said exterior clamp bracket is defined by a steel plate having an upper flange and a lower flange disposed on opposing edges of said plate.

7. The emergency door lock system of claim 2, wherein said exterior clamp bracket comprises a plurality of holes defined through said clamp bracket substantially corresponding in location to said threaded holes in said u-brackets when said u-brackets are mated to said exterior bracket, each of said plurality of holes configured to allow a threaded fastener to pass through said exterior clamp bracket and contact the door to secure said lock system to the door.

8. The emergency door lock system of claim 7, wherein when said threaded fasteners contact the door, a tip of said threaded fastener indents the door, such that said threaded fastener protrudes at least partially into the dimension of the door defined by the exterior face of the door.

9. The emergency door lock system of claim 1, further comprising an interior bracket cover and an exterior bracket cover, wherein said interior cover is removably attached to said interior clamp bracket such that said interior clamp bracket is substantially covered by said interior cover and allowing said lock pin to pass though said interior cover and said bracket pin slot, wherein said exterior cover is removably attached to said exterior clamp bracket such that said exterior clamp bracket is substantially covered by said exterior cover.

10. The emergency door lock system of claim 9, wherein said interior cover further comprises a guide sleeve disposed on an interior of the body of said interior cover to guide said lock pin between said vertical pin holes disposed in said upper and lower flanges of said interior bracket as the operator inserts said lock pin into said door lock system.

11. The emergency door lock system of claim 1, further comprising a floor plate disposed on a floor below said interior clamp bracket, said floor plate containing a floor lock pin hole having a center that is substantially coaxial with the center of said bracket pin slot when the door is in a closed position, said floor lock pin hole defining said remote pin slot such that said lock pin is capable of engaging a resilient and robust remote engagement point.

12. The emergency door lock system of claim 1, further comprising a lock pin floor sleeve disposed on a floor below said interior clamp bracket, said floor sleeve containing a floor lock pin hole having a center that is substantially coaxial with the center of said bracket pin slot when the door is in a closed position, said floor lock pin hole defining said remote pin slot such that said lock pin is capable of engaging a resilient and robust remote engagement point.

13. The emergency door lock system of claim 1, further comprising an alarm system removably coupled to said lock pin such that when said lock pin is removed from said alarm system, said alarm system emits an alert.

14. The emergency door lock system of claim 13, wherein said alert is one of an audible alert, a visual alert, and a combination audible and visual alert.

15. The emergency door lock system of claim 13, wherein said alert is projected to one of an area on an interior side of the door and an area on an exterior side of the door.

16. An emergency door lock system, comprising:

an insertable lock pin comprising an elongate rod having a generally uniform cross section along an operative region thereof;

an interior clamp bracket;

an exterior clamp bracket; and a plurality of u-brackets;

wherein said interior clamp bracket is configured to contact against an interior of a door, said exterior clamp bracket is configured to contact against an exterior of the door, and said plurality of u-brackets support, secure, and provide a clamping force to said interior and exterior clamp bracket to secure the door lock system on the door, wherein the clamping force is provided by a plurality of threaded fasteners disposed in a plurality of threaded holes through at least one portion of said u-brackets;

wherein said u-brackets are removably fastened to said exterior clamp bracket by at least some of said plurality of threaded fasteners comprising a plurality of threaded screws;

wherein said interior clamp bracket is defined by a steel plate having an upper and a lower flange disposed on opposing edges of said plate, said flanges each including a vertical pin hole;

wherein said exterior clamp bracket is defined by a steel plate having an upper and a lower flange disposed on opposing edges of said plate;

wherein said vertical pin holes disposed through said upper and lower flanges of said interior clamp define a bracket pin slot configured to accept said lock pin and allow said lock pin to pass through said bracket pin slot;

wherein said lock pin is configured to engage said interior clamp bracket through said bracket pin slot and simultaneously engage a remote pin slot to secure the door in a closed position;

wherein said lock pin is portable;

wherein said plurality of u-brackets are removably fastened to said exterior clamp bracket such that said door lock system is dissassembleable and removable from the door for emergency removal.

17. The emergency door lock system of claim 16, further comprising an interior bracket cover and an exterior bracket cover, wherein said interior cover is removably attached to said interior clamp bracket such that said interior clamp bracket is substantially covered by said interior cover and allowing said lock pin to pass though said interior cover and said bracket pin slot, wherein said exterior cover is removably attached to said exterior clamp bracket such that said exterior clamp bracket is substantially covered by said exterior cover.

18. A method for securing a door, said method comprising:

closing a door if it is open, the door having an emergency door lock system removeably mounted proximate an edge portion of the door;

inserting a lock pin into a lock pin hole on a portion of the emergency door lock system on an interior side of the door after the door has been closed, the lock pin engaging the emergency door lock system mounted on the door and engaging a remote pin slot remotely spaced adjacent the emergency door lock system when the door is closed; and if emergency entry is required through the closed door, removing the emergency door lock system from an exterior side of the door including removing an exterior cover from the emergency door lock system, removing a plurality of mechanical fasteners from an exterior bracket of the emergency door lock system, sliding a plurality of u-brackets of the emergency door lock system away from each other, and opening the door outward if the door is an out-swinging door, and if the door is an in-swinging door, removing the lock pin of the emergency door lock system with a lock removal tool and opening the door inward.

* * * * *